US008888095B1

(12) United States Patent
Ihara

(10) Patent No.: US 8,888,095 B1
(45) Date of Patent: Nov. 18, 2014

(54) PROCESSING APPARATUS OF CARDS AND SHEETS

(71) Applicant: Ai & Di Co., Ltd., Osaka (JP)

(72) Inventor: Atsumi Ihara, Osaka (JP)

(73) Assignee: Ai & Di Co., Ltd., Osaka (JP)

( * ) Notice: Subject to any disclaimer, the term of this patent is extended or adjusted under 35 U.S.C. 154(b) by 0 days.

(21) Appl. No.: 14/036,859

(22) Filed: Sep. 25, 2013

(51) Int. Cl.
*B65H 29/54* (2006.01)
*B65H 31/26* (2006.01)
*B65H 31/24* (2006.01)

(52) U.S. Cl.
CPC ..... *B65H 31/24* (2013.01); *B65H 31/26* (2013.01)
USPC ..... 271/303; 271/176; 271/207

(58) Field of Classification Search
CPC ..... B65H 29/58; B65H 31/24
USPC ..... 271/303, 298, 176, 207; 414/790.9
See application file for complete search history.

(56) References Cited

U.S. PATENT DOCUMENTS

| | | | | |
|---|---|---|---|---|
| 3,189,342 | A * | 6/1965 | Bocock | 271/303 |
| 6,260,843 | B1 * | 7/2001 | Hoshimura et al. | 271/213 |
| 7,556,261 | B2 * | 7/2009 | Luquet et al. | 271/207 |
| 7,686,296 | B2 * | 3/2010 | Kaneko et al. | 271/220 |
| 8,038,145 | B2 * | 10/2011 | Hirabayashi et al. | 271/207 |
| 8,371,568 | B2 * | 2/2013 | Herrmann et al. | 270/52.16 |

* cited by examiner

*Primary Examiner* — David H Bollinger
(74) *Attorney, Agent, or Firm* — Young & Thompson

(57) ABSTRACT

A processing apparatus of cards, etc., includes a stacker, which can lead a card overflowed from a main stacker automatically to an extension stacker. The apparatus includes a stacker provided by a main stacker, an extension stacker at the downstream side of the main stacker, and a switching mechanism for switching discharge of the card from the main stacker to the extension stacker. The switching mechanism includes a stopper to which a tip of the card overflowed from the main stacker is contacted and stopped, and a switching slope switching the discharged card from a main stacker discharging posture to an extension stacker discharging posture. When the card overflows from the main stacker, the card is contacted with the stopper and the switching slope is automatically switched to the extension stacker discharging posture, and the card next to the overflowed is discharged to the extension stacker with a correct order.

10 Claims, 7 Drawing Sheets

PROCESSING APPARATUS OF CARDS AND SHEETS

TECHNICAL FIELD

The present invention relates to a processing apparatus of cards and sheets equipped with a stacker which can receive and accommodate processed cards or sheets, particularly to a processing apparatus of cards and sheets equipped with an extensible stacker.

BACKGROUND ART

Cards made of paper or plastics have been used as identification cards such as a membership certificate, a student's identification card, an employee identification card, etc., or a ticket, a business card, a tag, etc. To these cards, printing or writing (processing) of various information is carried out by a printer or a magnetic type card reader writer, etc.

Processed cards are generally discharged (released) to an output stacker, and stacked up (accommodated). The stacker is a box state member an upper surface of which is generally opened, and a number of the cards to be accommodated is determined by the height (depth) of the stacker. When a working efficiency is considered, it is desired to increase a number of the cards to be accommodated. In such a case, a height of the stacker is required to be heightened, accordingly, a discharging position of the card of the processing apparatus is also required to be heightened. As a result, the height of the apparatus becomes high, which contradicts to the demand to make the apparatus compact.

In the case of a desktop type small-sized printer, for example, a number of accommodable sheets is 30 sheets to 75 sheets in the case of a card made of a plastic of JIS standard with a thickness of 0.76 mm. Incidentally, an input stacker which sends a card into a printer generally has a larger capacity for a number of the cards to be accommodated than that of an output stacker (for example, 200 sheets). This is because, the input stacker can be easily made high to the upper direction (space), but the output stacker cannot be made high than the card discharge port of the apparatus since the card falls with its own weight. Incidentally, in recent years, a size of the printer tends to be small, and the height of the card discharging port becomes lower.

If a number of the discharged cards exceeded the capacity of the stacker, the discharged cards collide with each other and the discharging operation becomes impossible whereby it causes failure of the apparatus or the cards might be damaged. Also, the cards that exceeded the capacity scatter at around the stacker, and it is necessary to collect the scattered cards with hands and stack up. Here, when the order of the cards has been decided, the order might be disturbed when the cards are collected. Therefore, it is necessary to monitor the stacker by a person at the timing of filling the cards near to the brim.

If the cards are overflowed from the stacker, even if the scattered cards are collected, the order of the cards is disturbed. Then, it is necessary to permute the cards to the correct order, or, to confirm the order, it is necessary to check the card preparation data and the actual cards, so that it takes time and becomes a work to likely cause errors.

DISCLOSURE OF THE INVENTION

Problems to be Solved by the Invention

The present invention has been done in view of the above-mentioned problems, and an object thereof is to provide a processing apparatus of cards and sheets having a stacker which can lead the cards or sheets overflowed from the stacker after the main stacker is filled with the cards or sheets to an extension stacker automatically.

Means to Solve the Problems

The processing apparatus of cards and sheets (in the following, also referred to cards, etc.) of the present invention is an apparatus for processing cards, etc., and as a stacker in which processed cards, etc., are discharged and stacked up, which comprises a main stacker provided at an upstream side of a discharging direction of the cards, etc., and capable of accommodating a predetermined number of the cards, etc., and an extension stacker provided at a downstream side of the main stacker, and as a switching mechanism for switching discharge of the cards, etc., from the main stacker to the extension stacker, which comprises a detecting portion for detecting the cards, etc., overflowed to the main stacker, and a switching slope for sliding down cards into the extension stacker, the cards following the card which is detected by the detecting portion.

According to the present invention, an extension stacker is provided adjacent to a downstream side to the discharging direction of the cards, etc., of a main stacker. When the cards, etc., overflowed from the main stacker is detected by a detecting portion, a switching slope is automatically exchanged to a position (posture) which guides the discharged cards, etc., to the extension stacker. And the cards, etc., following next to the overflowed card are discharged to the extension stacker in the correct order and stacked up. Therefore, a number of the cards to be accommodated can be increased, and the cards, etc., can be accommodated with a correct order. According to this procedure, an interval of the timing to monitor the apparatus by a person becomes long. Further, a work to confirm order of the cards, etc., can be avoided and occurrence of errors in the order can be prevented. Incidentally, the overflowed first card is stayed in the main stacker.

It can be considered to be general that the cards, etc., to be detected is "the first" card overflowed, and the card guided to the extension stacker is "the second" card overflowed. However, the card to be detected, and the cards, etc., to be guided to the extension stacker may be the second, the third, or the fourth card, etc. Incidentally, the overflowed cards, etc., are retained on the main stacker by the detecting portion (stopper) so that these are not fallen from the main stacker.

Here, the cards include a membership certificate, a student's identification card, an employee identification card, a ticket, a tag, a business card, etc., which uses an IC card or a magnetic card made of paper or a plastic. Also, the processing apparatus includes a printer, a reader writer of an IC chip or a magnetic tape, and a laminator, etc. Further, the sheet includes paper, a film, etc. As the sheet processing apparatus, a printer and a laminator, etc., are included.

In the present invention, it is preferred that the detecting portion and the above-mentioned switching slope are provided to the above-mentioned extension stacker.

According to the present invention, a volume of the output stacker can be enlarged only by providing an extension stacker adjacent to the downstream side of the main stacker of various apparatuses.

In the present invention, the above-mentioned switching mechanism may have a stopper at which the tip of the cards, etc., overflowed from the above-mentioned main stacker is touched and the cards, etc., are stopped thereby, and which acts as the detecting portion by displacing with a small distance due to the touching of the above-mentioned cards, etc.; and a switching slope which can switch from a main stacker discharging posture to an extension stacker discharging posture by synchronizing with the displacement of the stopper. Incidentally, it is possible to carry out control and feeding of paper or card by an electric sensor.

According to the present invention, exchange to the extension stacker can be carried out only by a mechanical constitution. An electric detection part, etc., is not used so that wiring, etc., is not necessary whereby the structure is simple and it can be manufactured inexpensively.

The extension stacker of the present invention is an extension stacker placed at a downstream side to the discharging direction of the cards, etc., of a main stacker at which processed cards, etc., are discharged and stacked up in an apparatus for processing the cards, etc., which comprises a switching mechanism for switching discharge of the cards, etc., from the above-mentioned main stacker to the above-mentioned extension stacker, comprising a stopper at which the tip of the cards, etc., overflowed from the above-mentioned main stacker is touched and the cards, etc., are stopped thereby, and which acts as the detecting portion by displacing with a small distance due to the touching of the above-mentioned cards, etc.; and a switching slope which can switch from a main stacker discharging posture to an extension stacker discharging posture by synchronizing with the displacement of the stopper.

In these inventions, the above-mentioned stopper may have a contact part projected upward from an upper surface of the above-mentioned main stacker, and an engagement part with the above-mentioned switching slope; and is rotationally movably supported at ahead of the above-mentioned extension stacker to the discharging direction of the cards, etc.; and the switching slope has an engagement part for maintaining the switching slope to the main stacker discharging posture by engaging with the engagement part of the stopper; and a cover part for covering an opening of the upper surface of the main stacker at the extension stacker discharging posture, and leading the cards, etc., to the extension stacker; which is rotationally movably supported to the extension stacker at ahead and backward to the discharging direction of the cards, etc., and is biased so that it is rotated and moved to the extension stacker discharging posture.

Effects of the Invention

As can be clearly seen from the above explanation, according to the present invention, the apparatus is provided by a main stacker, and an extension stacker provided adjacent to a downstream side to the discharging direction of the cards, etc., of the main stacker. When the cards, etc., overflowed from the main stacker are detected by a detecting portion, a switching slope is automatically changed to the position (posture) which guides the discharged cards, etc., to the extension stacker. And the card next to the cards, etc., overflowed is discharged to the extension stacker with the correct order and stacked up. Thus, an interval of the timing for monitoring the apparatus by a person becomes long so that monitoring work can be saved.

Also, a number of the cards to be accommodated can be increased and the cards can be accommodated with the correct order. Therefore, it is not necessary to take time for rearranging the scattered cards or time for confirming that the card order is correct or not. Further, the discharged cards or sheets do not collide with each other, so that malfunction of the apparatus due to paper jam, etc., or breakage of the card can be prevented. Moreover, there is no possibility of causing an artificial mistake.

BRIEF DESCRIPTION OF THE DRAWINGS

FIG. 4(A) shows a state in which the switching slope is in a main stacker discharging posture, and FIG. 4(B) shows a state that the switching slope is switched to an extension stacker discharging posture.

FIG. 7(B) shows an oblique view.

EMBODIMENTS TO CARRY OUT THE INVENTION

Figure 1:
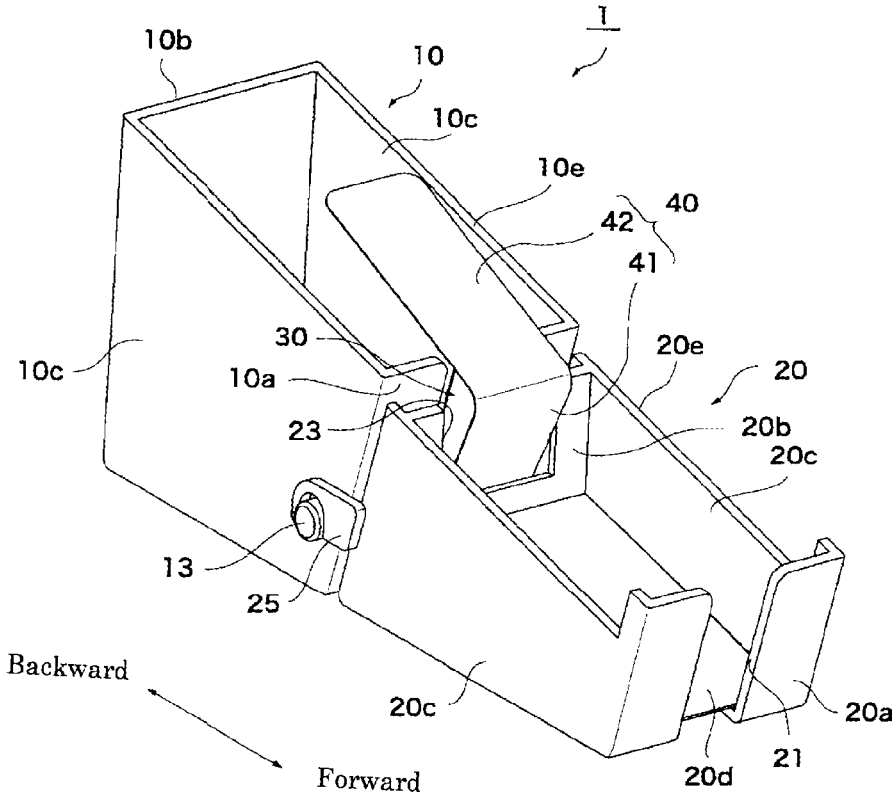
FIG. 1 is an oblique drawing of a stacker according to the embodiment of the present invention.

In the following, embodiments of the present invention are explained in detail by referring to the drawings.

Figure 2:
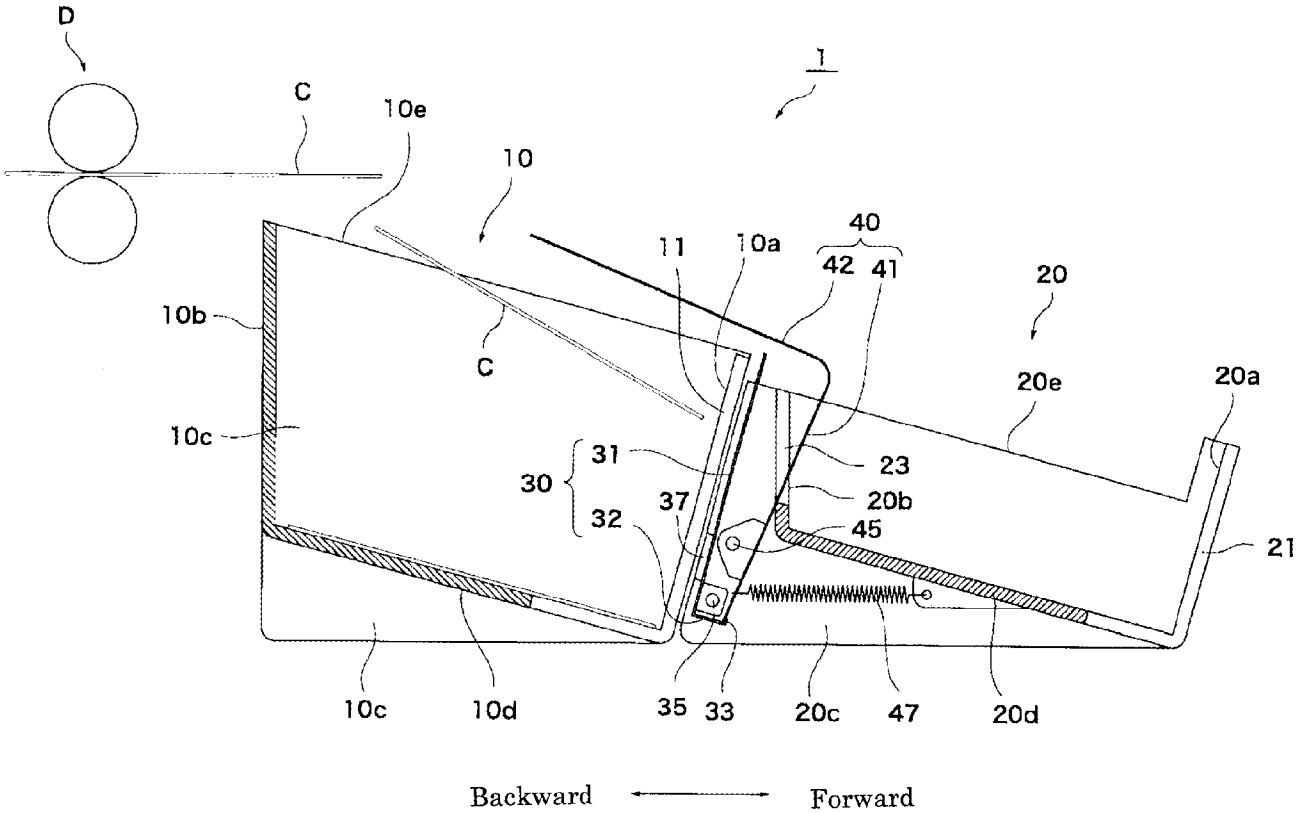
FIG. 2 is a sectional side view of the stacker of FIG. 1.

By referring to FIG. 1 and FIG. 2, the stacker to be provided to the card processing apparatus according to the embodiment of the present invention is explained. FIG. 1 is an oblique drawing showing the state that the main stacker and the extension stacker are linked. FIG. 2 is a sectional side view showing the state that the main stacker and the extension stacker are linked. Incidentally, in the following, processing of a card (simply also referred to as a card) is explained as an example, and it can be also used for the processing of a sheet such as paper or a film, etc. Also, as a switching mechanism, other than the pure mechanical system, an electric sensor may be used. Also, cards transfer at the slope may be an electrical driving system.

The stacker 1 is provided by a main stacker 10 provided at an upstream side to the card discharging direction at a discharging port of the processing apparatus, which is capable of accommodating a predetermined number of cards; and an extension stacker 20 linked at a downstream side of the main stacker 10. At the extension stacker 20, a switching mechanism (stopper 30, switching slope 40, etc.) is provided for switching discharge of the cards from the main stacker 10 to the extension stacker 20. This switching mechanism detects the first card overflowed the main stacker 10, and guides a card discharging next to the detected card to the extension stacker 20.

In each of drawings, the card discharging direction is made forward, the direction opposite thereto is made backward, and the direction crossing at right angles to the card discharging direction is made crosswise direction.

The main stacker 10 is a box state member in which an upper surface is opened, and has a front plate 10*a*, a back plate 10*b*, both side plates 10*c*, and a bottom plate 10*d*. As shown in FIG. 2, the bottom plate 10*d* is a rectangle having substantially the same size as that of the card, and inclined to downward (to forward) toward the downstream of the card discharging direction. Also, an upper surface 10*e* of the stacker 10 is also inclined to downward substantially in parallel to the bottom plate 10*d* toward forward. The front plate 10*a* is inclined slightly forward as crossing the bottom plate 10*d* at right angles. The back plate 10*b* is substantially right angled to a horizontal plane. According to this constitution, the hollow part of the main stacker 10 is broadened toward slightly upward.

A slit 11 with a predetermined width is formed over the center of the crosswise direction of the superior margin of the front plate 10*a* to the first portion of the bottom plate 10*d*. The slit 11 is for taking out the accommodated card.

Also, near to the forward end portion of the both side plates 10*c*, a projection 13 for linking with the extension stacker is formed.

Figure 3:
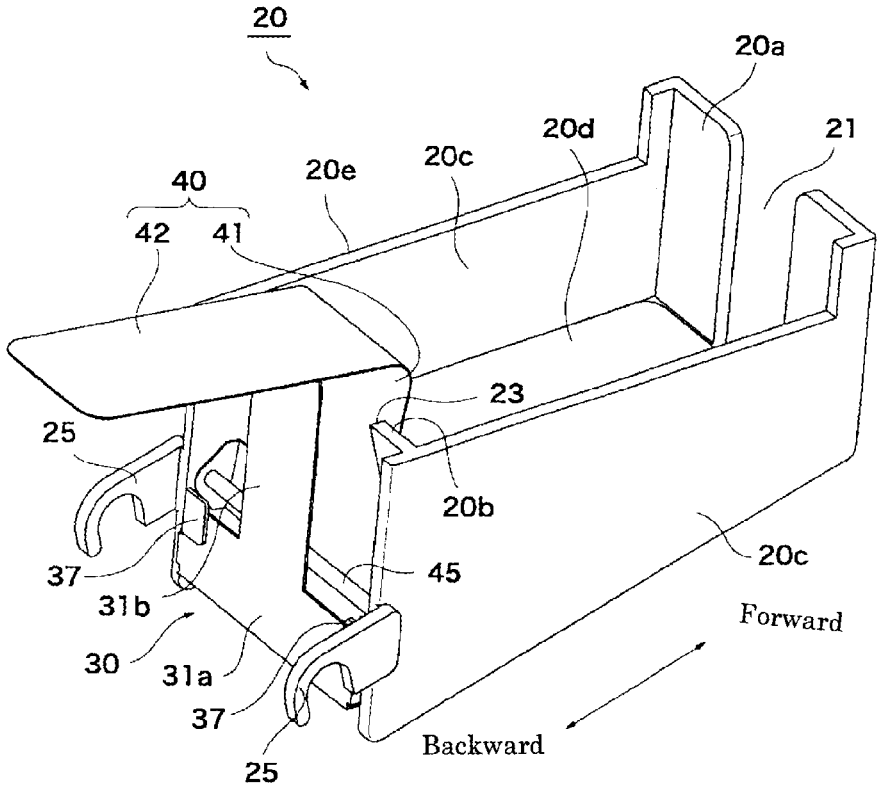
FIG. 3 is an oblique drawing of an extension stacker.

The extension stacker explained by also referring to FIG. 3. FIG. 3 is an oblique drawing of the extension stacker.

The extension stacker 20 is also a box state member in which an upper surface is opened, and has a front plate 20*a*, a back plate 20*b*, both side plates 20*c*, and a bottom plate 20*d*. The bottom plate 20*d* is a rectangle having substantially the same size as that of the card, and inclined to forward toward the downstream with substantially the same inclined angle of the bottom plate 10*d* of the main stacker 10. An upper surface 20*e* of the stacker 20 is inclined to forward toward the downstream at the height slightly lower than the front edge of the upper surface 10*e* of the main stacker 10 with substantially the same inclined angle of the bottom plate 20*d*. The front plate 20*a* is inclined slightly forward as crossing the bottom plate 20*d* at right angles. The both side plates 20*c* are extended backward than the back plate 20*b*. The back edge of the both side plates 20*c* are inclined slightly forward substantially in parallel to the front plate 20*a*.

A slit 21 with a predetermined width is formed over the center of the crosswise direction of the superior margin of the front plate 20*a* to the first portion of the bottom plate 20*d*. This is for taking out the accommodated card.

A slit 23 with a predetermined width is formed at the back plate 20*b* which extends over the center of the crosswise direction of the upper end to near the bottom end. Into the slit 23, a switching slope 40 is entered as mentioned below.

Also, near to the backward end portion of the both side plates 20*c*, a hook part 25 engaging with the projection 13 for linking with the extension stacker is formed.

The switching mechanism is constituted by a stopper 30 to which a tip of the card overflowed from the main stacker 10 is contacted, and a switching slope 40 for switching the discharged card from the main stacker discharging posture to the extension stacker discharging posture.

The stopper 30 is, as shown in FIG. 2 and FIG. 3, provided at backward than the back plate 20*b* of the extension stacker 20 between the back edges of the both side plates 20*c*, and has a contact part 31 to which the tip of the card is abutted, and an engagement part 32 which is engaged with a switching slope 40 mentioned below.

The contact part 31 is so provided as to opposing to the back plate 20*b* of the extension stacker 20, has a base part 31*a* which is long to the crosswise direction, and a projected portion 31*b* extended from the center of the base part 31*a* toward upward, and is a planar shape with a reverse T character.

The engagement part 32 is extended toward forward from the bottom edge of the base part 31*a* of the contact part 31 substantially at right angles. At the front edge of the engagement part 32, a connection piece 33 which is folded upward substantially at right angles is formed. With this connection piece 33, the bottom end of a switching slope 40 mentioned below is engaged.

As shown in FIGS. 2 and 3, the right and left edges of the base part 31*a* of the contact part 31 of the stopper 30 are supported by the rotation axis 35 rotationally movably at the inside of the both side plates 20*c* of the extension stacker 20. According to this constitution, the stopper 30 is rotationally movable from a normal posture to forward with the rotation axis 35 as the center. The normal posture is a posture shown in FIG. 2, and is a posture (a posture inclined slightly forward) in which the contact part 31 is substantially in parallel to the back edges of the both side plates 20*c* of the extension stacker 20. The stopper 30 is restricted to move and rotate to the anticlockwise direction of the drawing from the normal state by the stopping part 37 formed at the back edges of the both side plates 20*c* of the extension stacker 20. The length (height) to the longitudinal direction of the contact part 31 is mentioned below.

The switching slope 40 is provided between the stopper 30 and the back plate 20*b* which are between back edges of the both side plates 20*c* of the extension stacker 20, and has an engagement part 41 which is engaged with the above-mentioned engagement part 32 of the stopper 30, and a cover part 42 which hangs over the opening of the main stacker 10. The engagement part 41 is so provided as to opposing to the back plate 20*d* of the extension stacker 20, and the height thereof is slightly higher than that of the contact part 31 of the stopper 30. The cover part 42 is extended backward substantially the right angles from the upper edge of the engagement part 41 to over the upper edge of the stopper 30. A width of the engagement part 41 and the cover part 42 is slightly narrower than the width of the slit 23 formed at the back plate 20*b* of the extension stacker 20. A length of the cover part 42 is mentioned below.

The bottom part of the engagement part 41 of the switching slope 40 is extended to right and left, and supported by the rotation axis 45 rotationally movably at right and left edges, of inside of the both side plates 20*c* of the extension stacker 20. The rotation axis 45 is positioned forward than the rotation axis 35 and connection piece 33 of the stopper 30. According to this constitution, the switching slope 40 is rotationally movable toward forward and backward with the rotation axis 45 as the center.

A spring 47 is configured between the downward portion than a rotationally movable axis 45 of the engagement part 41 of the switching slope 40 and substantially center of the bottom surface of the bottom plate 20*d* of the extension stacker 20. The spring 47 is biased so as to rotationally move backward with the rotation axis 45 of the switching slope 40 as the center.

Engagement of the stopper 30 and the switching slope 40 is explained.

The stopper 30 is maintained to the normal posture (a posture in which the contact part 31 is substantially in parallel to the back edge of the both side plates 20*c* of the extension stacker 20) by the stopping part 37. The switching slope 40 is engaged with the connection piece 33 of the engagement part 32 of the stopper 30 at the bottom edge of the engagement part 41. Since the connection piece 33 is positioned toward backward than the rotationally movable axis 45 of the switching slope 40, the downward portion is pulled toward backward than the rotationally movable axis 45 of the engagement part 41 of the switching slope 40, and according to this constitution, the switching slope 40 is maintained at the state where it is rotationally moved to the most forward. That is, the engagement part 41 of the switching slope 40 is slightly inclined toward forward and entered into the slit 23 formed at the back plate 20*b* of the extension stacker 20, and the front surface is contacted to the bottom surface of the slit 23.

When the extension stacker 20 in the state where the stopper 30 and the switching slope 40 are engaged is linked to the main stacker 10, as shown in FIG. 1 easily understandable, a hook part 25 of the extension stacker 20 hang on the projected portion 13 of the main stacker 10. According to this constitution, the extension stacker 20 is arranged adjacent to the downstream of the main stacker 10, and the contact part 31 of the stopper 30 of the extension stacker 20 is opposed substantially in parallel to the front plate 10*a* of the main stacker 10. Here, the upper edge of the projected portion 31*b* of the contact part 31 is positioned at higher than the upper edge of the front plate 10*a* of the main stacker 10. An interval between the upper edge of the front plate 10*a* of the main stacker 10 and the upper edge of the projected portion 31*b* of the contact part 31 of the stopper 30 is thicker than the thickness of a sheet of the card.

Also, the cover part 42 of the switching slope 40 is positioned upward than the upper surface 10*e* of the main stacker 10, and a space with a certain degree is present between the cover part 42 and the upper surface 10*e* of the main stacker 10 (main stacker discharging posture).

As shown in FIG. 2, the card C1 discharged from the discharge roller D (or discharging port) of the processing apparatus is fallen to the main stacker 10 by its own weight, and stacked up in the stacker 10. At this time, the cover part 42 of the switching slope 40 is apart from the upper surface 10*e* of the main stacker 10 so that the cover part 42 does not prevent from falling the card C 1.

Figure 4:
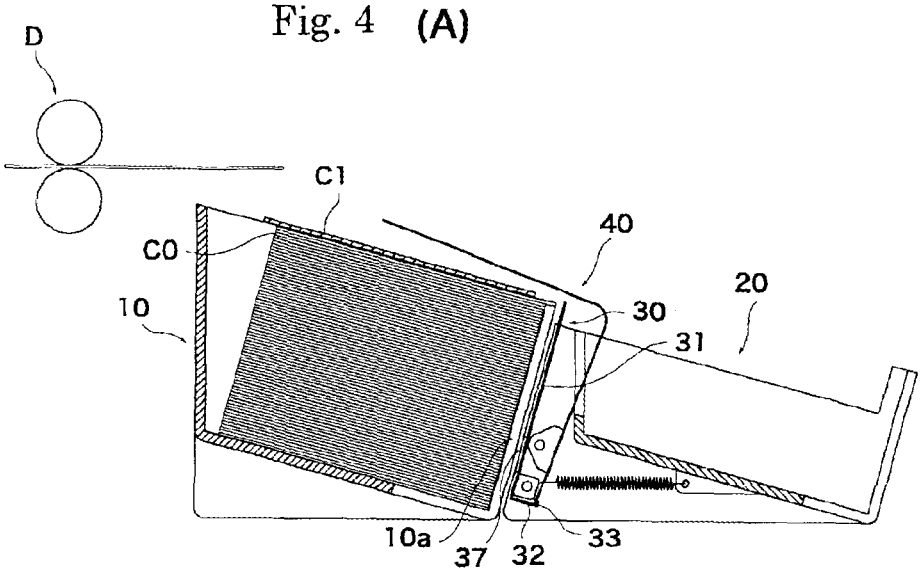
FIG. 4 is a drawing explaining switching a switching slope.
Figure 4:
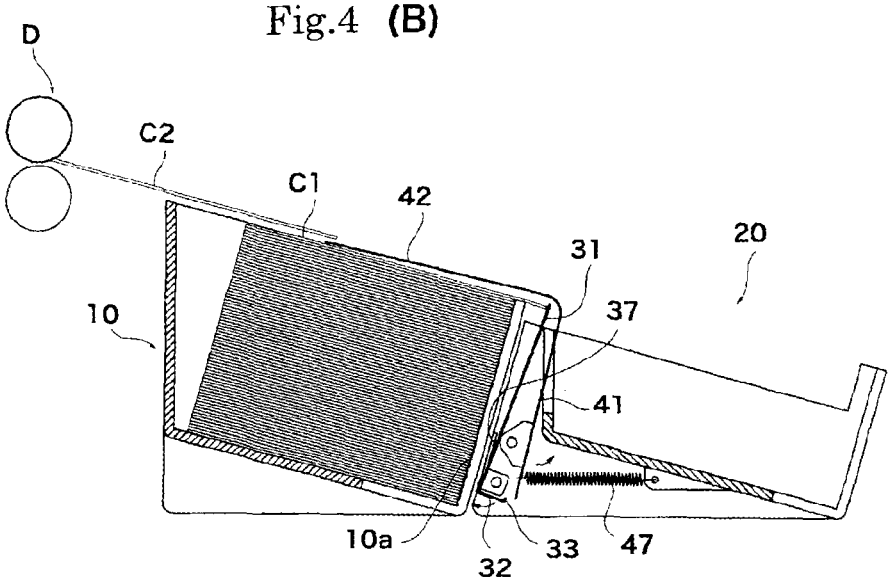
Figure 5:
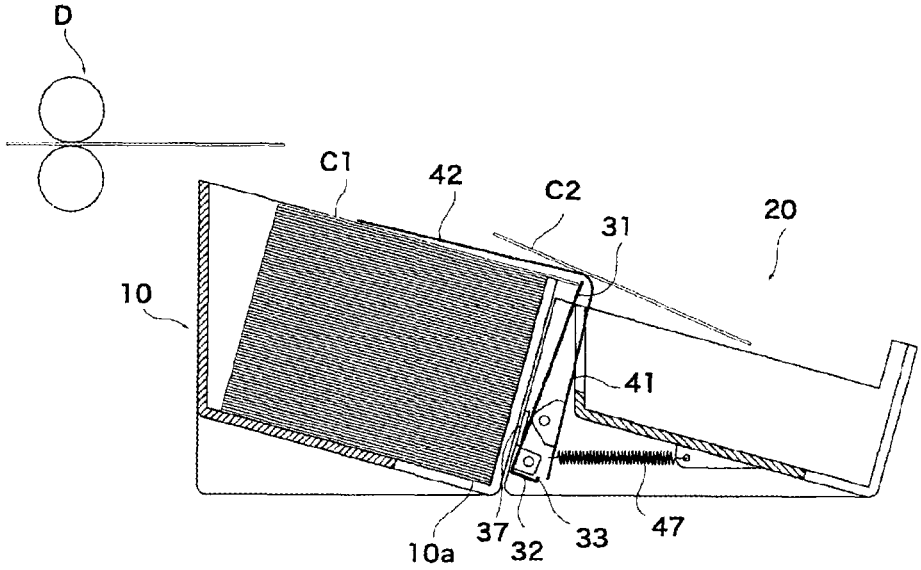
FIG. 5 is a drawing showing the state that a card is discharged after switching a switching slope to the extension stacker discharging posture.

By referring to FIG. 4 and FIG. 5, the state of being switched the card overflowed from the main stacker to the extension stacker is explained.

As shown in FIG. 4 (A), it is assumed that the main stacker 10 was filled with the $n^{th}$ card C0. Since the bottom plate 10*d* of the main stacker 10 is inclined downward toward the forward, the card is also stacked up with a posture inclined downward toward the forward. Therefore, the front edge of the $n^{th}$ card C0 is contacted to the front plate 10*a* of the main stacker 10. Next, when the $(n+1)^{th}$ card C1 is discharged, the card C1 falls on the upper surface of the $n^{th}$ card C0, and slips forward by its own weight along with the surface.

The card C1 is, as shown in FIG. 4 (B), contacted with the contact part 31 of the stopper 30 of the extension stacker 20 exceeding the front plate 10*a* of the main stacker 10. Then, the contact part 31 of the stopper 30 is pushed by the $(n+1)^{th}$ card C1, and rotationally moved to forward with the rotation axis 35 as the center. After that, the engagement part 32 of the stopper 30 which has been engaged with the engagement part 41 of the switching slope 40 is then rotationally moved to backward, and these are disengaged. According to this constitution, the switching slope 40 is biased by the spring 47 to rotationally move to backward. Then, the cover part 42 of the switching slope 40 is rotationally moved so as to cover the opening of the upper surface of the main stacker 10, and the tip of the cover part 42 is contacted with the upper surface of the $(n+1)^{th}$ card C1. Here, the cover part 42 is inclined downward slightly toward forward (extension stacker discharging posture). Also, since a force to rotationally move to backward has been applied to the switching slope 40 by the spring 47, the tip of the cover part 42 is pressed by the upper surface of the card C1.

Incidentally, a length of the cover part 42 is only a length from the discharge portion D to the contacting portion at which the front edge of the discharged card is contacted with the upper surface of the cover part 42. That is, it is necessary to avoid the situation that the front edge of the discharged card is not reached to the cover part 42. This length is determined by the positional relationship of the front-back direction and the perpendicular direction of the discharge portion D and the stacker 1.

Next, when the $(n+2)^{th}$ card C2 is discharged, the front edge of the card C2 is contacted with the upper surface of the cover part 42 of the switching slope 40. Since the cover part 42 is inclined downward toward forward, it falls with its own weight as such along with the cover part 42, and guided to the extension stacker 20 as shown in FIG. 5. Thus, the cards of the $(n+2)^{th}$ or later are guided to the extension stacker 20 along with the cover part 42 of the switching slope 40, and stacked up.

Figure 6:
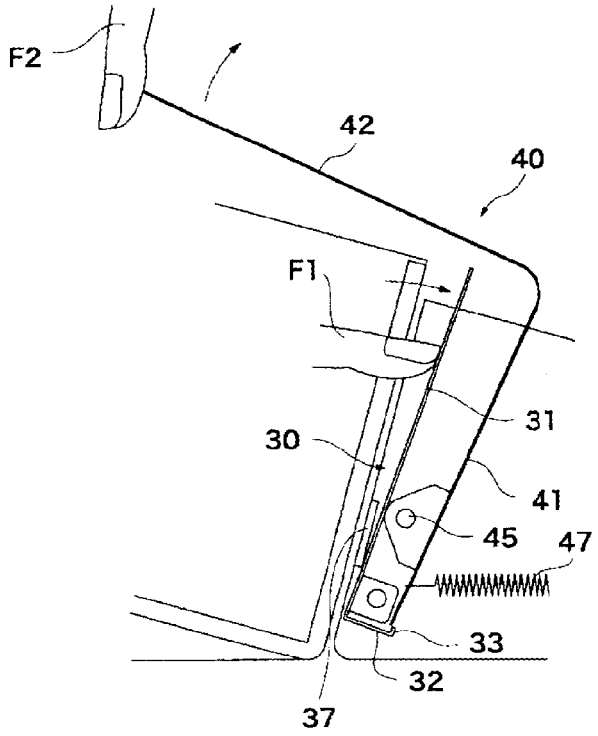
FIG. 6 is a drawing explaining the procedure for engaging a switching slope and a stopper.

Next, in the extension stacker 20, a method of engaging the stopper 30 and the switching slope 40 is explained by referring to FIG. 6.

As shown in FIG. 6, the contact part 31 of the stopper 30 is pushed forward by a finger F1 to rotationally move the contact part 31 to forward and the engagement part 32 backward (left direction of the drawing). Then, the cover part 42 of the switching slope 40 is pulled up forward with other finger F2 to rotationally move to forward. According to this constitution, the downward portion of the rotationally movable axis 45 of the engagement part 41 of the switching slope 40 is rotationally moved to backward. At this time, the bottom edge of the engagement part 41 of the switching slope 40 reaches backward over the upper edge of the connection piece 33 of the engagement part 32 of the stopper 30. When the stopper 30 is returned to the normal posture, the connection piece 33 of the engagement part 32 of the stopper 30 is engaged with the bottom end of the engagement part 41 of the switching slope 40.

Incidentally, it is preferred that switching of the switching slope 40 from the main stacker discharging posture to the extension stacker discharging posture is detected by a sensor, and alert it by lighting a lamp or sounding a buzzer, etc.

The switching mechanism comprising the stopper 30, the switching slope 40, the spring 47, etc., is worked at the $(n+1)^{th}$ card and accommodated a card from the $(n+2)^{th}$ or later into the extension stacker 20 in the above-mentioned example, and it may be so constituted that it is worked at the $(n+2)^{th}$ card (or later than it), and accommodated a card from the $(n+3)^{th}$ (or later than it) into the extension stacker 20. A thickness or a weight of the stopper 30 or the switching slope 40, strength of the spring 47, and the position of the rotationally movable supporting point, etc., can be optionally selected depending on the own weight of the card, etc.

Figure 7:
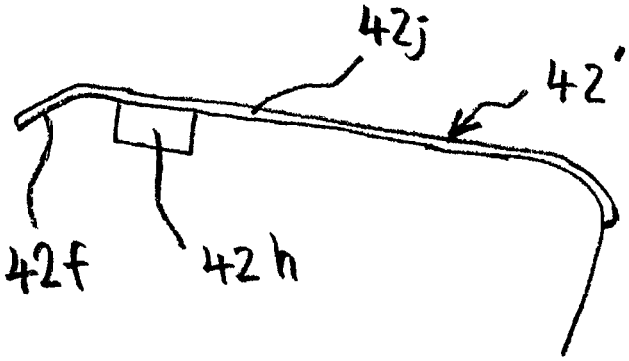
FIG. 7 is a drawing explaining a design modification of the cover part 42, FIG. 7 (A) shows a side view.
Figure 7:
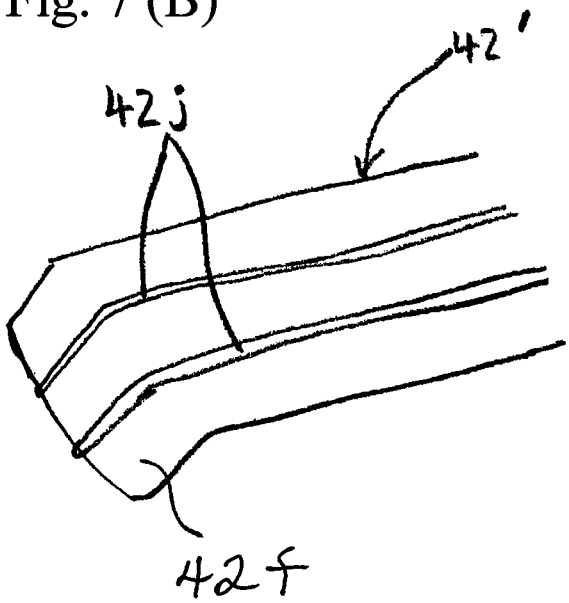

FIG. 7 is a drawing explaining a design modification of the cover part 42, FIG. 7 shows a side view, and FIG. 7(B) shows an oblique view. A downwardly bend portion 42*f* is added to the backward tip of the cover part 42' for smoother card guiding onto the cover part 42. In FIG. 7(A), a weight 42*h* is attached on the under surface of the backward tip portion of the cover part 42' in replacement for the spring 47. Ribs (raised lines) 42*j* elongate on the top surface of the cover part 42' along the forward and backward direction, thus reducing friction on the surface and realizing smoother sliding of the cards.

EXPLANATION OF REFERENCE NUMERALS

| | | | |
|---|---|---|---|
| 1: | Stacker, | | |
| 10: | Main stacker, | 11: | Slit, |
| 13: | Projection, | | |
| 20: | Extension stacker, | 21: | Slit, |
| 23: | Slit, | 25: | Hook part, |
| 30: | Stopper, | 31: | Contact part, |
| 32: | Engagement part, | 33: | Connection piece, |
| 35: | Rotation axis, | 37: | Stopping part, |

-continued

| | | | |
|---|---|---|---|
| 40: | Switching slope, | 41: | Engagement part, |
| 42: | Cover part, | 45: | Rotation axis, |
| 47: | Spring. | | |

The invention claimed is:

1. A processing apparatus for processing cards or sheets, which comprises a stacker in which processed cards or sheets are discharged and stacked up, comprising a main stacker provided at an upstream side of a discharging direction of the cards or sheets, and capable of accommodating a predetermined number of the cards or sheets and an extension stacker provided at a downstream side of the main stacker; and a switching mechanism for switching discharge of the cards or sheets from the main stacker to the extension stacker, comprising a detecting portion for detecting a card or a sheet overflowing to the main stacker, and a switching slope for sliding down a card or a sheet discharged next the card or the sheet detected by the detecting portion into the extension stacker.

2. The processing apparatus of cards or sheets according to claim 1, wherein the detecting portion and the switching slope is provided to the extension stacker.

3. The processing apparatus of cards or sheets according to claim 2, wherein the switching mechanism has a stopper at which a tip of the cards or the sheets overflowed from the main stacker is touched and the cards or the sheets are stopped thereby, and which acts as the detecting portion by displacing with a small distance due to touching of the cards or the sheets; and a switching slope which can switch from a main stacker discharging posture to an extension stacker discharging posture by synchronizing with the displacement of the stopper.

4. The processing apparatus of cards or sheets or the extension stacker for cards or sheets according to claim 3, wherein the stopper has a contact part projected upward from an upper surface of the main stacker, and an engagement part with the switching slope; and is rotationally movably supported at ahead of the extension stacker to the discharging direction of the cards or the sheets; and the switching slope has an engagement part for maintaining the switching slope to a main stacker discharging posture by engaging with the engagement part of the stopper; and a cover part for covering an opening of an upper surface of the main stacker at an extension stacker discharging posture, and leading the cards or the sheets to the extension stacker;

which is rotationally movably supported to the extension stacker at ahead and backward to the discharging direction of the cards or the sheets and is biased so that it is rotated and moved to the extension stacker discharging posture.

5. The processing apparatus of cards or sheets or the extension stacker for cards or sheets according to claim 2, wherein the stopper has a contact part projected upward from an upper surface of the main stacker, and an engagement part with the switching slope; and is rotationally movably supported at ahead of the extension stacker to the discharging direction of the cards or the sheets; and the switching slope has an engagement part for maintaining the switching slope to a main stacker discharging posture by engaging with the engagement part of the stopper; and a cover part for covering an opening of an upper surface of the main stacker at an extension stacker discharging posture, and leading the cards or the sheets to the extension stacker;

which is rotationally movably supported to the extension stacker at ahead and backward to the discharging direction of the cards or the sheets and is biased so that it is rotated and moved to the extension stacker discharging posture.

6. The processing apparatus of cards or sheets according to claim 1, wherein the switching mechanism has a stopper at which a tip of the cards or the sheets overflowed from the main stacker is touched and the cards or the sheets are stopped thereby, and which acts as the detecting portion by displacing with a small distance due to touching of the cards or the sheets; and a switching slope which can switch from a main stacker discharging posture to an extension stacker discharging posture by synchronizing with the displacement of the stopper.

7. The processing apparatus of cards or sheets or the extension stacker for cards or sheets according to claim 6, wherein the stopper has a contact part projected upward from an upper surface of the main stacker, and an engagement part with the switching slope; and is rotationally movably supported at ahead of the extension stacker to the discharging direction of the cards or the sheets; and the switching slope has an engagement part for maintaining the switching slope to a main stacker discharging posture by engaging with the engagement part of the stopper; and a cover part for covering an opening of an upper surface of the main stacker at an extension stacker discharging posture, and leading the cards or the sheets to the extension stacker;

which is rotationally movably supported to the extension stacker at ahead and backward to the discharging direction of the cards or the sheets and is biased so that it is rotated and moved to the extension stacker discharging posture.

8. The processing apparatus of cards or sheets or the extension stacker for cards or sheets according to claim 1, wherein the stopper has a contact part projected upward from an upper surface of the main stacker, and an engagement part with the switching slope; and is rotationally movably supported at ahead of the extension stacker to the discharging direction of the cards or the sheets; and the switching slope has an engagement part for maintaining the switching slope to a main stacker discharging posture by engaging with the engagement part of the stopper; and a cover part for covering an opening of an upper surface of the main stacker at an extension stacker discharging posture, and leading the cards or the sheets to the extension stacker;

which is rotationally movably supported to the extension stacker at ahead and backward to the discharging direction of the cards or the sheets and is biased so that it is rotated and moved to the extension stacker discharging posture.

9. An extension stacker for cards or sheets placed at a downstream side to a discharging direction of the cards or the sheets of a main stacker at which processed cards or sheets are discharged and stacked up in an apparatus for processing the cards or the sheets which comprises a switching mechanism for switching discharge of the cards or the sheets from the main stacker to the extension stacker, comprising a stopper at which the tip of the cards or the sheets overflowing from the main stacker is touched and the cards or the sheets are stopped thereby, and which acts as the detecting portion by displacing with a small distance due to touching of the cards or the sheets; and a switching slope which can switch from a main stacker discharging posture to an extension stacker discharging posture by synchronizing with displacement of the stopper.

10. The processing apparatus of cards or sheets or the extension stacker for cards or sheets according to claim 9, wherein the stopper has a contact part projected upward from an upper surface of the main stacker, and an engagement part with the switching slope; and is rotationally movably supported at ahead of the extension stacker to the discharging direction of the cards or the sheets; and the switching slope has an engagement part for maintaining the switching slope to a main stacker discharging posture by engaging with the engagement part of the stopper; and a cover part for covering an opening of an upper surface of the main stacker at an extension stacker discharging posture, and leading the cards or the sheets to the extension stacker;

which is rotationally movably supported to the extension stacker at ahead and backward to the discharging direction of the cards or the sheets and is biased so that it is rotated and moved to the extension stacker discharging posture.

* * * * *